United States Patent [19]

Belmont et al.

[11] Patent Number: 4,813,793

[45] Date of Patent: Mar. 21, 1989

[54] REINFORCED HANDLE FOR THERMOPLASTIC DRAW TAPE BAGS

[75] Inventors: Kirk E. Belmont, Fairport; Edward M. Bullard, East Rochester; Daniel J. DiBiasi, Pittsford; Edward W. Forman, Jr.; David E. McIntyre, both of Palmyra, all of N.Y.

[73] Assignee: Mobil Oil Corporation, New York, N.Y.

[21] Appl. No.: 201,723

[22] Filed: Jun. 3, 1988

[51] Int. Cl.[4] ..... B65D 33/28

[52] U.S. Cl. ..... 383/75; 383/76; 383/6; 383/17; 229/DIG. 6

[58] Field of Search ..... 383/75, 72, 76, 92, 383/17, 6; 229/DIG. 6

[56] References Cited

U.S. PATENT DOCUMENTS

| | | | |
|---|---|---|---|
| 3,029,853 | 12/1959 | Piazzi | 383/75 |
| 3,506,048 | 4/1970 | Jortikka | 383/75 |
| 3,592,379 | 7/1971 | Nakamura | 383/75 |
| 3,738,568 | 6/1973 | Ruda | 383/75 |
| 4,210,244 | 7/1980 | Westrick | 383/15 |
| 4,384,602 | 5/1983 | Ores | 383/8 |
| 4,558,463 | 12/1985 | Boyd | 383/75 |
| 4,592,091 | 5/1986 | Italici | 383/15 |
| 4,597,750 | 7/1986 | Boyd | 493/346 |
| 4,617,008 | 10/1986 | Boyd | 493/248 |
| 4,624,654 | 11/1986 | Boyd | 493/248 |
| 4,628,536 | 12/1986 | Herrington | 383/75 |
| 4,714,143 | 12/1987 | Saliba | 383/14 |

FOREIGN PATENT DOCUMENTS 1125363 8/1968 United Kingdom .

*Primary Examiner*—Willis Little

*Attorney, Agent, or Firm*—Alexander J. McKillop; Charles J. Speciale

[57] ABSTRACT

A padded reinforced handle for thermoplastic draw tape bags and method of making the same is disclosed. The padded hand-grip reinforcement for the draw tape handle is produced by folding a thermoplastic draw tape longitudinally into a V-shaped cross-section and inserting a predetermined quantity of padding material into the V-shaped cross section of the tape to provide a padded tape area at predetermined spaced intervals corresponding to the width of the draw tape bag. The padded tape section has a length adequate to provide a padded hand-grip reinforcement. The padded tapes are inserted into the hems of the draw tape bag with the padded tape section aligned with a central cut out opening intermediate the ends of the hems. The ends of the draw tape at the unpadded tape sections are secured to the ends of the respective hems so that when the padded tape section is gripped and pulled through the cut out openings in the hems to draw closed the open top of the bag, the padded hand-grip reinforcement minimizes the discomfort caused by roping at the hand area while the bag is under load. In a preferred form of the invention the padding material comprises a curable foam which is cured by ultraviolet light.

5 Claims, 1 Drawing Sheet

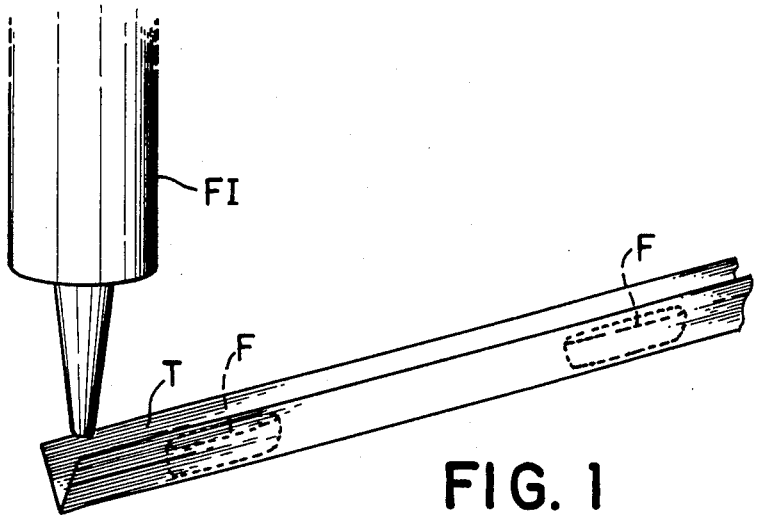
FIG. 1
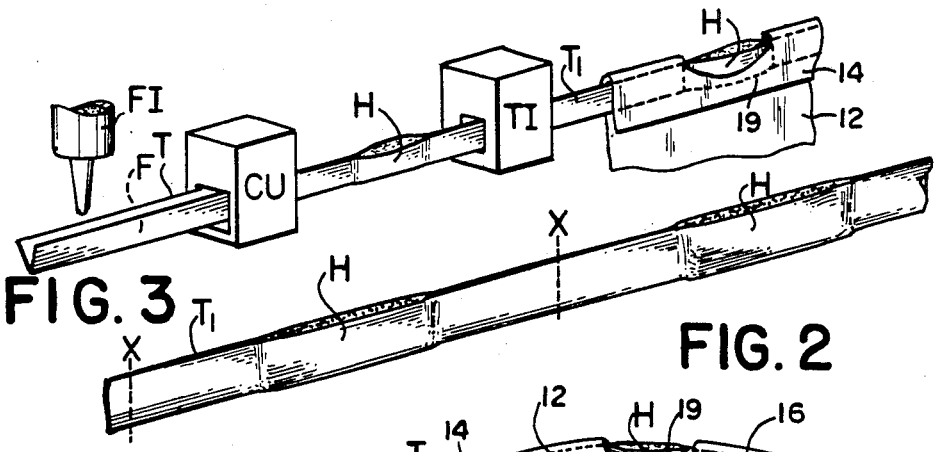
FIG. 3
FIG. 2
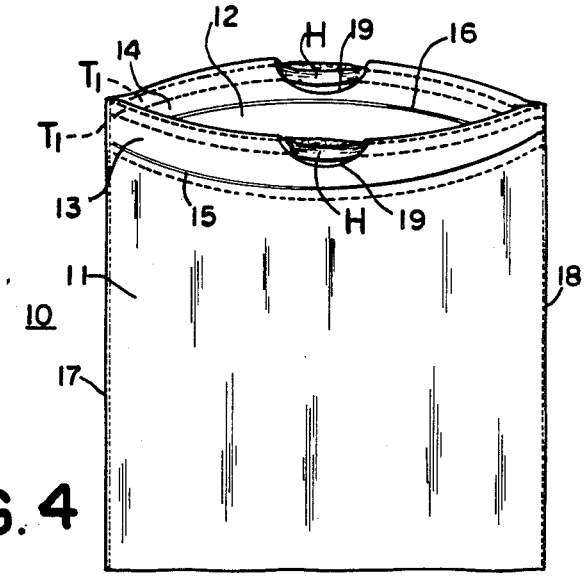
FIG. 4

REINFORCED HANDLE FOR THERMOPLASTIC DRAW TAPE BAGS

FIELD OF THE INVENTION

The present invention relates to thermoplastic draw tape handles inserted in hems of thermoplastic bags, and in particular, to a reinforced draw tape handle especially designed to minimize the discomfort caused by "roping" at the hand area while the bag is under load. The term "roping" refers to the tendency to form a round cross-section with a small diameter across the palm of the hand of the carrier in low gauge/high strength thermoplastic draw tapes while the bag is under load.

BACKGROUND OF THE INVENTION

Bags made of thin polyethylene material have been used in various sizes. Small bags are used in packaging of sandwiches and the like. Larger bags are used as shopping bags. Even larger bags are used for containing trash.

A particularly advantageous closure for such a bag includes a draw tape made from the same polyethylene material as the bag. U.S. Pat. No. 3,029,853 - Piazzi, British Pat. No. 1,125,363 - Jortikka, U.S. Pat. No. 3,738,568 - Ruda, U.S. Pat. No. 4,558,463 - Boyd and U.S. Pat. No. 4,624,654 Boyd et al are examples of draw tape bags. Such closures have been successfully employed in these bags. Draw tape closures for large bags, and the manufacture of these draw tape bags are described in the aforesaid related patents U. S. Pat. Nos. 4,558,463 and 4,624,654. Other related patents are U.S. Pat. No. 4,617,008 -Boyd et al which describes a hem forming apparatus and U.S. Pat. No. 4,597,750 - Boyd et al which describes apparatus for inserting a draw tape into the bag. Bags having intermittently oriented draw tapes are disclosed in related U.S. Pat. No. 4,628,536 - Herrington. The disclosure of the foregoing related patents are incorporated herein by reference.

In the past, thermoplastic bag structures with integral handle elements formed as an integral part of the bag structure itself have been produced by a method which reduces stress concentration. Stress points around the bag mouth are distributed to areas which are less likely to rupture as a result of stress concentration. See U.S. Pat. No. 4,165,832 - Kuklies et al. This patent discloses a thermoplastic bag structure with integral handle elements, i.e. the handles are actually an extension of the bag proper and stress relief notches ar positioned at opposite ends of the mouth. This patent also discusses the effect of "roping" while the bag is under load. Another technique that has been employed in the past in connection with integral handles of thermoplastic bags is to place patches of additional thermoplastic material around the handle openings. These patches are heat sealed or spot welded to the handle portions.

Draw tape bags have a draw tape that is a separate structure from the bag proper. Draw tape bags of the type made according to the above mentioned Boyd et al patents normally have a 1" wide draw tape for the full width of the bag. When the tape is pulled hard to close the bag, it elongates over most of its length and the area where it is gripped by the hand, becomes narrow, or "ropes" and hurts the hand. It is possible to make a draw tape that is sufficiently strong at thin gauges, such as 1.5 mils, but this tape is unsatisfactory for use because of the "roping" effect. As a result, it has been customary to use a tape material that is thicker, thus more costly than that which is required for performance. For example, tape thicknesses that have been used are in the order of 3 to 4 mils, about twice what is actually required.

It is desirable to produce a thermoplastic bag handle of a smaller gauge, less costly material, while substantially preventing "roping at the area of the handle held by the hand of the carrier. It is also desirable to minimize the discomfort caused by roping by providing a hand-grip at the central area of the handle.

The following related patent applications disclose draw tape configurations for draw tape bags especially designed to reduce stress concentrations or "roping" and/or to provide a hand-grip at the hand area while the draw tape bag is under load.

RELATED APPLICATIONS

"Ribbed Draw Tape for Thermoplastic Bag" , Edward M. Bullard, Ser. No. 71, 196, filed July 9, 1987 describes a draw tape for a bag having transverse or angular ribs which reduce roping of the draw tape when lifting a loaded bag. "Variable-Width Draw Tape for Thermoplastic Bags", Daniel J. DiBiasi and Fox J. Herrington, Ser. No. 134,270 filed Dec. 14, 1987 describes a draw tape for a bag where the draw tape is made wider at the center are where it is gripped by hand for forcing any elongation to occur at some other point thereby preventing .roping at the hand area. "Non-Roping Thermoplastic Draw Tape for Thermoplastic Bags", Daniel J. DiBiasi and David A. Bryniarski, Ser. No. 157,753 filed Sept. 1, 1988 describes a reinforced draw tape handle with a reinforcing patch. "Method and Apparatus for Making Non-Roping Thermoplastic Draw Tape for Thermoplastic Bags", David A. Bryniarski and E. Grosz, Ser. No. 157,751 filed Feb. 19, 1988 describes a method and apparatus to permit continuous application of a reinforcing patch to a draw tape at the center area where it is gripped by hand. "Hand-Grip for Thermoplastic Draw Tape Handles for Thermoplastic Bags", Kirk Belmont et al, Ser. No. 201,799 filed June 3, 1988 describes a hand-grip for a draw tape bag and method of making the same. "Multiple Layer Hand-grip Reinforcement for Thermoplastic Draw Tape Handles for Thermoplastic Bags", Kirk Belmont et al Ser. No. 201,798 Filed June 3, 1988 describes a multiple layer hand-grip reinforcement handle for draw tape bags and method of making the same. The disclosures of the foregoing applications are assigned to the same assignee as the present application and are incorporated herein by reference.

SUMMARY OF THE INVENTION

It is an object of the invention to provide a thermoplastic draw tape bag wherein the discomfort caused by "roping" at the central area of the handle of low gauge/high strength thermoplastic draw tapes held by the hand of the carrier is reduced by providing padding at the central are of the draw tape handle to provide a padded hand-grip reinforcement in the handle. It is a further object of the invention to provide a method of making a padded hand-grip reinforcement for a draw tape handle which is relatively easy to manufacture.

In accordance with one aspect of the invention there is provided a thermoplastic draw tape bag for carrying trash and the like having a padded hand-grip reinforcement for the draw tape handle. The bag comprises two thermoplastic panels forming an open top, closed bottom bag, the panels being joined along the sides of the bag. A hem o each of the panels is folded over adjacent the top, the bottom and ends of each hem being sealed to the adjacent panel, each of the hems having a cut out opening intermediate the ends of the hems. A thermoplastic draw tape handle is disposed in each hem secured to the ends of the hem and each draw tape comprising a tape folded longitudinally throughout its length to provide a double layer tape having a V-shaped cross-section, each tape having a center section and two side sections. The side sections are secured to the ends of the hem and the center section is in alignment with the cut out opening. The center section has a padding material inserted into the V-shaped cross-section and has a length adequate to provide a padded hand-grip reinforcement for the tape so that when the center section is gripped and pulled through the cut out opening in the hems to draw closed the open top of the bag the padded hand-grip reinforcement minimizes the discomfort caused by roping at the center section while the bag is under load.

In accordance with another aspect of the invention there is provided a method of making a padded hand-grip reinforcement in a low gauge/high strength thermoplastic draw tape for thermoplastic draw tape bags. The method comprises the steps of folding a tape longitudinally into a double layer tape having a V-shaped cross section and inserting a padding material into the V-shaped tape to provide a padded tape section at predetermined intervals corresponding to the width of the draw tape bags. Each draw tape comprises a padded tape section having a length adequate to provide a padded hand-grip reinforcement intermediate two unpadded tape sections. One of the tapes is inserted into each hem of a draw tape bag with the padded tape section aligned with a central cutout opening intermediate the ends of the hems. The ends of each draw tape at the unpadded tape sections are secured to the ends of the respective hems so that when the padded tape section is gripped and pulled through the cut out opening in the hems to draw closed the open top of the bag, the padded hand-grip reinforcement minimizes the discomfort caused by roping at the hand area while the bag is under load.

The foregoing and other objects, features and advantages of the invention will be more apparent from the following detailed description and appended claims.

SHORT DESCRIPTION OF THE DRAWINGS

FIG. 1 shows a thermoplastic draw tape folded longitudinally into a double layer tape having a V-shaped cross-section and having a curable foam injected at predetermined spaced locations;

FIG. 2 illustrates the draw tape of FIG. 1 after passing through a foam curing unit to provide reinforced padded handles formed into the draw tape at the predetermined locations;

FIG. 3 schematically illustrated the folded draw tape having a curable foam injected therein and passing through a curing unit and then into tape inserter unit after which it enters the hem of a draw tape bag; and FIG. 4 shows a perspective view of a thermoplastic draw tape bag embodying the draw tapes with the padded handgrip reinforcement handles in accordance with the present invention.

DESCRIPTION OF THE PREFERRED EMBODIMENT

The method of making a padded hand-grip reinforcement for thermoplastic draw tape handles for thermoplastic bag is illustrated in FIGS. 1–3. A draw tape bag 10 embodying the present invention is illustrated in FIG. 4. As shown in FIG. 1 a thermoplastic draw tape T having a width twice as wide as the desired finished draw tape is folded longitudinally into a double ply tape having a V-shaped cross-section. The folded tape T with the open end of the "V" disposed upwardly is advanced beneath a foam injetor FI. The foam injector FI is operated at predetermined intervals to inject a predetermined quantity of curable foam F into the "V" of the tape at predetermined locations. These locations correspond to the width of the draw tape bags into which the draw tape is to be inserted as hereinafter described. The curable foam may be of any rapidly curing type such for example as an ultraviolet cured foam which enables the foam to be cured in a matter of seconds. The folded tape T with the uncured foam F deposited therein passes through a suitable ultraviolet curing unit CU, FIG. 3, where the foam F is cured and the two sides of the V-cross section of the tape are secured together by the cured foam to provide a reinforced foam-padded handle H in the tape. The tape after it leaves the curing unit is illustrated in FIG. 2 with the reinforced handles H formed into the tape $T_1$ at the predetermined spaced locations.

As previously pointed out the foam making up the reinforced handles H is injected into the folded tape at spaced locations corresponding to the width of the draw tape bags to be manufactured. More particularly, the vertical center lines of the handles H are spaced apart a distance corresponding to the width of the bags to be manufactured. When the tape $T_1$ is inserted into the hems of the draw tape bags it will be severed along the dotted lines X—X which are midway between the handles H. Thus it will be seen that each draw tape $T_1$ comprises a padded tape section H having a length adequate to provide a padded hand-grip reinforcement intermediate two unpadded tape sections. The tape of FIG. 2 is fed to a tape inserter TI, FIG. 3, in a thermoplastic draw tape bag manufacturing line where the tape is fed into the respective hems of the thermoplastic bags being manufactured. While only one hem of the thermoplastic bag is illustrated in FIG. 3 it is to be understood that the draw tapes $T_1$ would be fed in dual fashion so that they concurrently enter both hems of the draw tape bag as later described in connection with FIG. 4. Bag manufacturing lines of this type are disclosed in the aforesaid patent U.S. Pat. Nos. 4,597,750 and 4,624,654 and incorporated by reference herein.

A draw tape bag 10 embodying the draw tape of FIG. 2 is illustrated in FIG. 4. The bag 10 includes two panels 11 and 12, formed from an extruded tube of polyethylene which is slit along the side to form an open top. Each panel 11 and 12 is folded over adjacent the top to form hems 13 and 14 respectively for receiving the padded draw tapes $T_1$. Prior to inserting the draw tapes each of the hems 13 and 14 is provided with a central cut out opening 19 intermediate the ends of the hems. The draw tapes $T_1$ are inserted into the respective hems 13, 14 and the hems are heat sealed horizontally at 15 and 16. The side edges of the panels 11 and 12 are heat sealed at 17 and 18 along with the ends of the respective hems 13 and 14 and the unpadded ends of the draw tapes $T_1$. The panels 11 and 12 are cut from the tube in a perpendicular direction along with the draw tapes $T_1$ and to complete the draw tape bag 10. As may be seen in FIG. 4 the central cut out openings 19 intermediate the ends of the each hem permit the padded handles H of the draw tapes $T_1$ to be grasped and thereafter pulled out through the openings 19. The hand-grip reinforcements H for each of the draw tapes $T_1$ are aligned with the openings 19. When the bag 10 is loaded, the draw tapes $T_1$ are grasped at the center section by the hand-grip reinforcements H and pulled through the cut out openings 19 thereby moving the open mouth of the bag to a closed condition. The padded hand-grip reinforcements H, minimize the discomfort caused by roping at the center section of the draw tape while the bag is under load.

While the invention has been described in connection with the injection of a curable foam into the folded tape spaced locations, it is to be understood that other padding materials other than a curable foam can be inserted into the folded tape and registered with the pull out hole 19. These padding materials can be held in place with adhesives or by heat sealing to form the padded hand-grip reinforcements as illustrated in the drawing. It is to be understood that the alternative padding material would be inserted by a suitable injecter into the V-shaped tape and then passed through a suitable sealing unit rather than a curing unit as diagrammatically illustrated in FIG. 3.

What is claimed is:

1. A thermoplastic draw tape bag for-carrying trash and the like having a padded hand-grip reinforcement for the draw tape handle comprising:

two thermoplastic panels forming an open top, closed bottom bag, the panels being joined along the sides of the bag;

a hem on each of said panels folded over adjacent the top, the bottom and ends of each hem being sealed to the adjacent panel, each of the hems having a cut out opening intermediate the ends of the hems; and a thermoplastic draw tape handle disposed in each hem secured to the ends of said hem and each draw tape comprising a tape folded longitudinally throughout its length to provide a V-shaped cross section, each tape having a center section and two side sections, the side sections being secured to the ends of the hems and the center section being in alignment with said cut out opening and comprising a padded tape area, the padded tape area having a padding material inserted into the V-shaped center section and having length adequate to provide a padded hand-grip reinforcement for the tapes that when the center section is gripped and pulled through the cut out opening in the hems to draw closed the open top of the bag, the padded hand-grip reinforcements H minimize the discomfort caused by roping at the center section while the bag is under load.

2. A thermoplastic draw tape bag according to claim 1 wherein said padding material in said padded hand-grip reinforcement comprises a cured plastic foam material.

3. A method of making a padded hand-grip reinforcement in a low gauge/high strength thermoplastic draw tape for thermoplastic draw tape bags comprising the steps of:

folding a thermoplastic draw tape longitudinally into a V-shaped cross-section;

inserting a predetermined quantity of padding material into the V-shaped cross-section of the tape to provide a padded tape area at predetermined spaced intervals corresponding to the width of the draw tape bag, each draw tape comprising a padded tape section intermediate two unpadded tape sections, the padded tape section having a length adequate to provide a padded hand-grip reinforcement;

inserting one of the padded tapes into each hem of a draw tape bag with the padded tape section aligned with a central cut out opening intermediate the ends of the hems; and securing the ends of each draw tape at the unpadded tape sections to the ends of the respective hems so that when the padded tape section is gripped and pulled through the cut out opening in the hems to draw closed the open top of the bag, the padded hand-grip reinforcement minimizes the discomfort caused by roping at the hand area while the bag is under load.

4. A method according to claim 3 wherein the padding material comprises a curable foam and including the step of curing the foam.

5. A method according to claim 3 including the step of sealing the padding material to the sides of the V-shaped cross-section of the tape.

* * * * *